US006007385A

United States Patent [19]

Wu

[11] Patent Number: 6,007,385

[45] Date of Patent: Dec. 28, 1999

[54] HIGH FREQUENCY ELECTRICAL CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/046,888

[22] Filed: Mar. 23, 1998

[30] Foreign Application Priority Data

Mar. 21, 1997 [TW] Taiwan ..... 86204491

[51] Int. Cl.[6] ..... H01R 9/03

[52] U.S. Cl. ..... 439/610; 439/607

[58] Field of Search ..... 439/607, 610, 439/701, 686, 682, 906, 608, 638, 609

[56] References Cited

U.S. PATENT DOCUMENTS

| | | | |
|---|---|---|---|
| 5,158,481 | 10/1992 | Frantz | 439/607 |
| 5,338,227 | 8/1994 | Nakamura | 439/607 |
| 5,364,291 | 11/1994 | Hashiguchi | 439/607 |
| 5,403,205 | 4/1995 | Hashiguchi | 439/607 |
| 5,417,590 | 5/1995 | Dechelette | 439/607 |
| 5,425,657 | 6/1995 | Davis | 439/610 |
| 5,456,618 | 10/1995 | Nakamura | 439/610 |
| 5,518,421 | 5/1996 | Davis | 439/607 |
| 5,660,558 | 8/1997 | Osanai | 439/353 |

*Primary Examiner*—Paula Bradley
*Assistant Examiner*—Ross Gushi

[57] ABSTRACT

An electrical connector includes an insulative housing having a reception surface for receiving a complementary connector, an engaging surface opposite the reception surface for connecting with an external cable including a plurality of cable lines, and a plurality of receptacles formed in the insulative housing in communication with the reception surface and the engaging surface. A plurality of contacts are respectively received in the receptacles of the insulative housing and each contact has a reception portion for electrically engaging with the corresponding cable line of the cable. First and second shieldings secured together enclose the insulative housing and at least one end of the first and second shieldings is secured to a peripheral edge of the reception surface of the insulative housing. A positioning member is adapted to be received between the engaging surface of the insulative housing and the two shieldings to abut against the engaging surface of the insulative housing, wherein passageways are defined in the positioning member in communication with the receptacles and retain the cable lines therein. The positioning member prevents sputtered plastic particles from entering an interior of the insulative housing via the engaging surface during formation of a plastic shell which encloses the two shieldings.

13 Claims, 6 Drawing Sheets

HIGH FREQUENCY ELECTRICAL CONNECTOR

BACKGROUND OF THE INVENTION

1. Field of the Invention

The present invention relates to a high frequency electrical connector, and particularly to an easily configured high frequency electrical connector which is durable and can effectively reduce noise.

2. The Prior Art

Conventional electrical connectors of high frequency input/output devices have structures similar to standard electrical connectors which comprise an insulative housing, a plurality of contacts received in the insulative housing, and one or more shielding members enclosing the insulative housing for suppressing noise. Other features of conventional high frequency connectors include the contacts thereof electrically connected between a cable and corresponding number of contacts of a complementary connector, and a shell or the like provided to enclose the shielding. Manufacture of the conventional electrical connector is laborious due to the above features which result in the following disadvantages:

i) plastic particles are sputtered during formation of the shell and tend to enter an interior of the insulative housing via the cable or the passageways of the housing thereby adversely affecting the electrical connection between contacts of the electrical connector and a complementary connector.

ii) The insertion end of the electrical connector is apt to deform due to friction from repeated insertions/detachments of the complementary connector thus diminishing the retention capability of the contacts received in the insulative housing which in turn weakens the electrical connection between contacts of the electrical connector and the complementary connector.

Therefore, an improved high frequency electrical connector is required which can overcome the disadvantages of the conventional electrical connectors.

SUMMARY OF THE INVENTION

The primary purpose of the present invention is to provide an improved high frequency electrical connector which can prevent plastic particles from entering an interior thereof during formation of an enclosing shell structure of the electrical connector.

Another purpose of the present invention is to provide an improved electrical connector which is capable of fixing contacts therein in position and firmly securing a cable connected thereto during repeated insertions/detachments of a complementary connector.

Another purpose of the present invention is to provide an improved high frequency electrical connector which can suppress noise by means of a shielding enclosure.

Another purpose of the present invention is to provide an improved high frequency electrical connector having a shielding member attached to a reception surface of an insulative housing thereof for protecting the housing from becoming worn due to repeated insertions/detachments of a complementary connector.

In accordance with one aspect of the present invention, an electrical connector comprises an insulative housing having a reception surface which defines a slot therein for receiving a complementary connector, an engaging surface opposite the reception surface for connecting with an external cable which comprises a plurality of cable lines, and a plurality of receptacles formed in the insulative housing in communication with the reception surface and the engaging surface of the insulative housing. A plurality of contacts are respectively received in the receptacles of the insulative housing and each contact has a reception portion for electrically engaging with the corresponding cable line of the cable. Shielding means comprises a first shielding and a second shielding secured together for enclosing the insulative housing and at least one end of the first and second shieldings is secured to a peripheral edge of the reception surface of the insulative housing. Positioning means is adapted to be received between the engaging surface of the insulative housing and the shielding means to abut against the engaging surface of the insulative housing, wherein passageways are defined in the positioning means in communication with the receptacles and retain the cable lines therein. Wherein the positioning means prevents sputtered plastic particles from entering an interior of the insulative housing via the engaging surface during formation of a plastic shell which encloses the shielding means.

DETAILED DESCRIPTION OF THE PREFERRED EMBODIMENT

Figure 1:
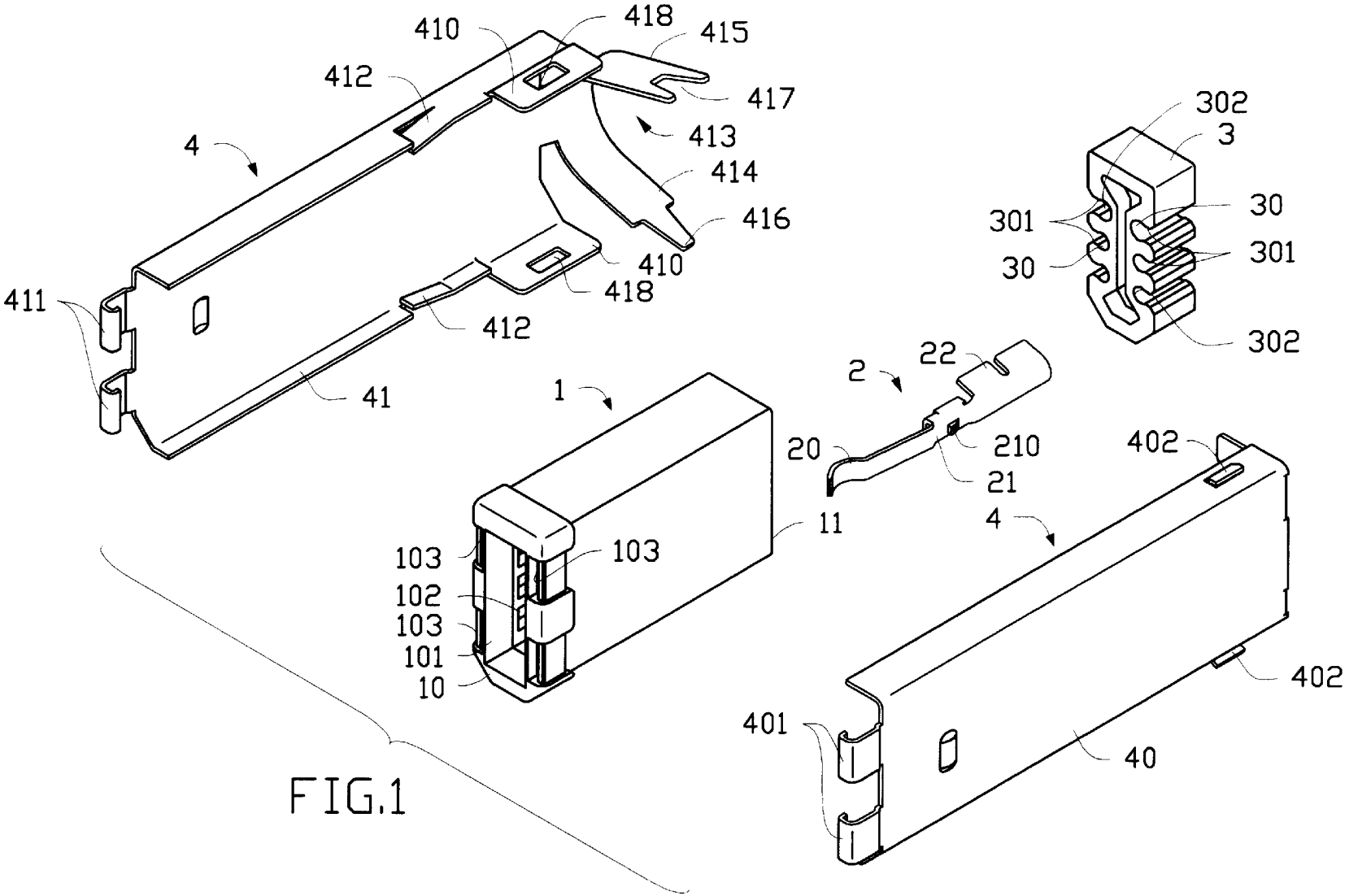
FIG. 1 is an exploded view of a electrical connector in accordance with the present invention.

Referring to FIG. 1, a high frequency electrical connector in accordance with the present invention comprises an insulative housing 1, a plurality of contacts 2, positioning means 3, and shielding means 4. The insulative housing 1 is substantially a rectangular structure which comprises a reception surface 10 and an engaging surface 11 opposite the reception surface 10. The reception surface 10 defines a slot 101 in a center portion thereof for receiving a complementary connector (not shown).

Six contact receptacles 102 each receiving a corresponding contact 2 therein are defined in opposite inner walls of the insulative housing 1 and separated from each other by interconnected gate structures (not shown) formed on the inner walls. Two pairs of recesses 103 are respectively defined in opposite peripheral edges of the insulative housing 1 which bound an opening of the slot 101.

Figure 3:
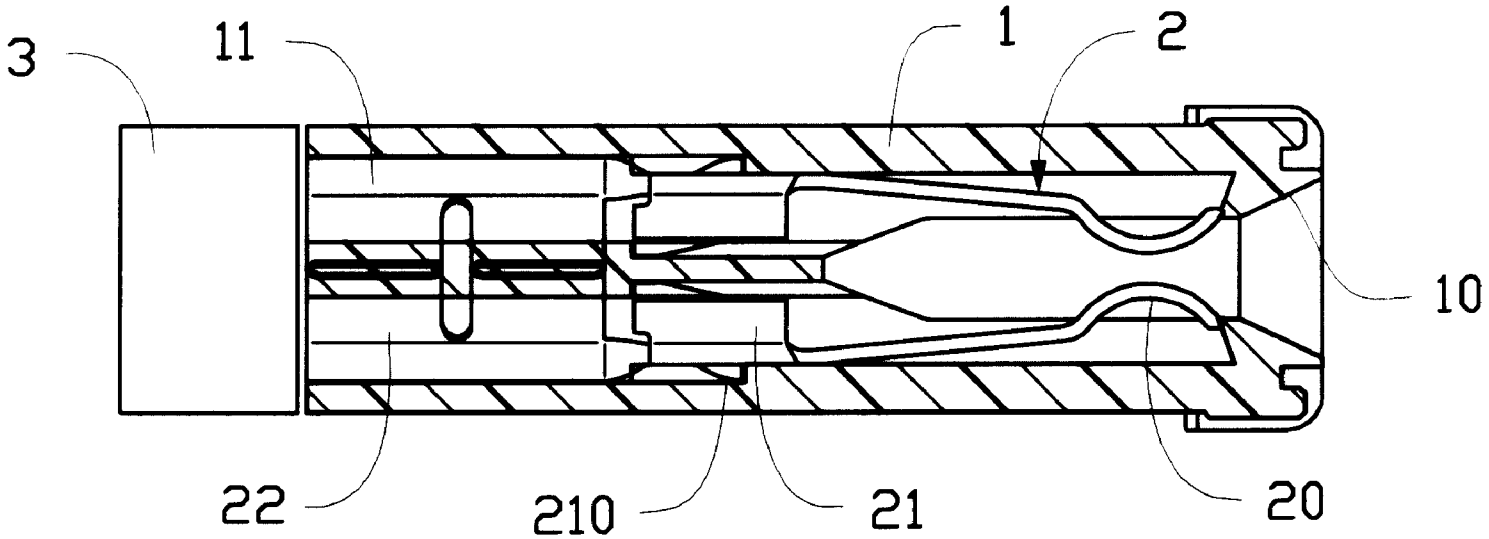
FIG. 3 is a cross-sectional view showing the relationship between the contacts and the insulative housing.

Also referring to FIG. 3, each contact 2 has a contacting portion 20 for electrically contacting a corresponding contact of the complementary connector, a positioning portion 21 including barbs 210 for retention within the receptacle 102, and a U-shaped reception portion 22 for receiving a cable line of a cable (not shown) therein.

The positioning means 3 is formed like a fish skeleton and defines six passageways 30 therein communicating with the six receptacles 102. Each passageway 30 has an entrance portion 301 and a reception portion 302, wherein the entrance portion 301 is narrower than the reception portion 302 which has substantially the same dimension as each cable line for retaining each cable line within the corresponding reception portion 302. The positioning means 3 is positioned adjacent to the engaging surface 11 of the insulative housing 1 after the cable lines of the cable are electrically connected to the U-shaped reception portion 22 of the corresponding contact 2.

Figure 2:
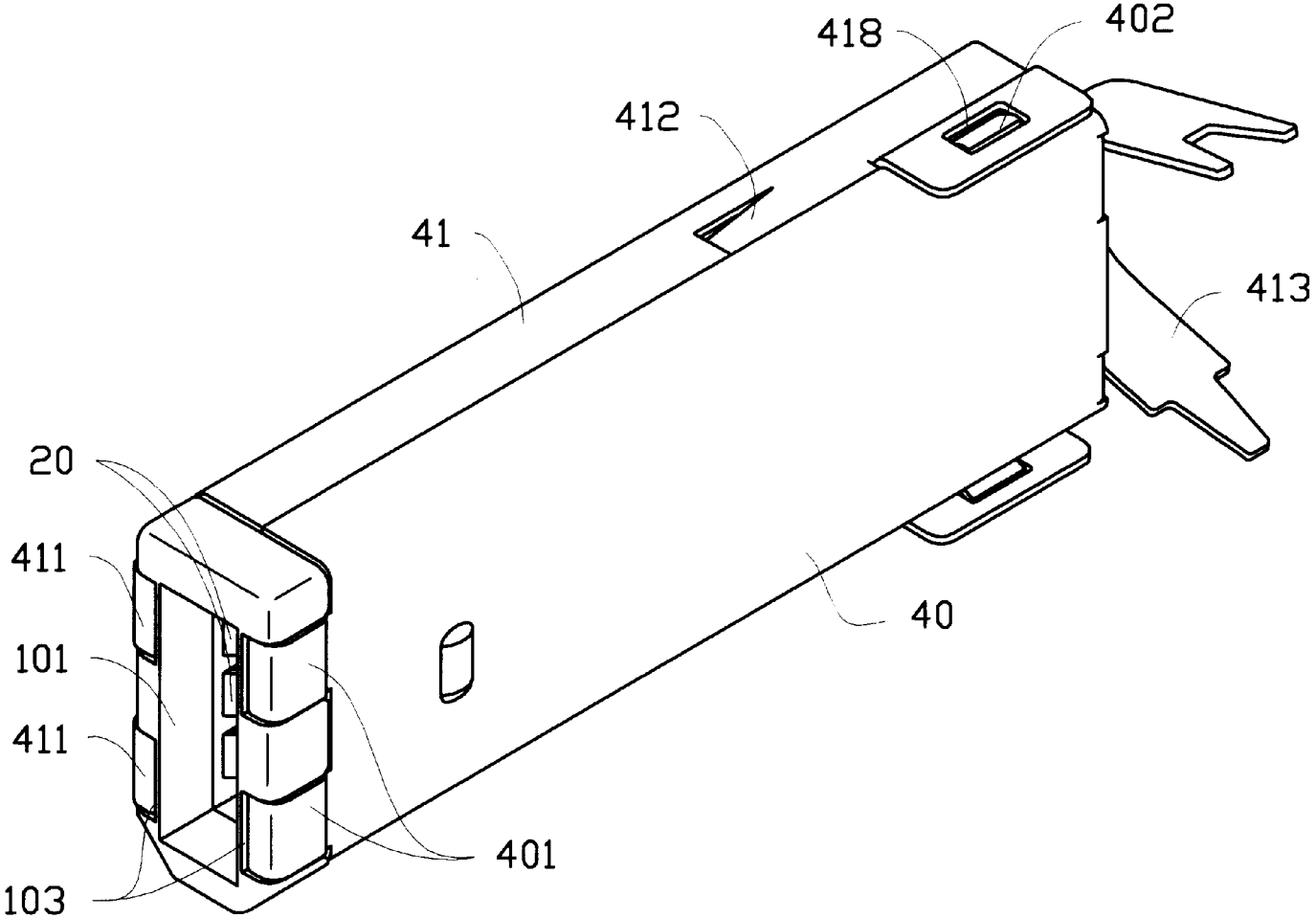
FIG. 2 is an assembled view of FIG. 1.
Figure 4:
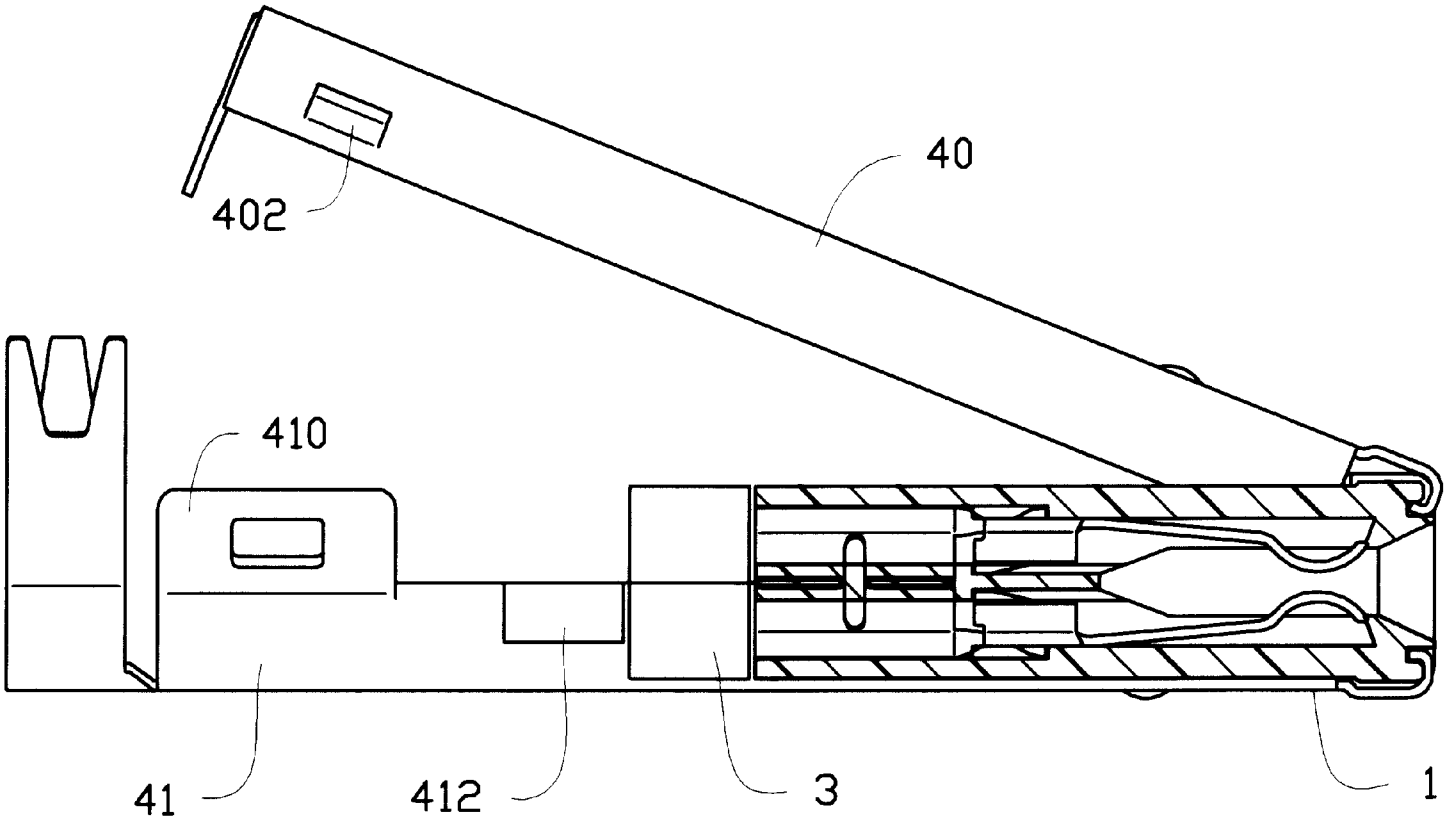
FIG. 4 illustrates how the shielding members are assembled with the insulative housing of the electrical connector.

The shielding means 4 comprises a first shielding 40 and a second shielding 41 both of which are substantially U-shaped and secured together to form a rectangular shell for enclosing the insulative housing 1. The first and second shieldings 40, 41 each comprise a pair of hooks 401, 411 extending therefrom for reception in the recesses 103 of the insulative housing 1 thereby fixing the shieldings 40, 41 to the reception surface 10 of the insulative housing 1. Two tabs 412 inwardly projecting from opposite side walls of the second shielding 41 abut against the positioning means 3 thereby urging the positioning means 3 against the engaging surface 11 of the insulative housing 1 as shown in FIG. 4. Two protrusions 402 are formed on opposite side walls of the first shielding 40 and two tabs 410 extending from opposite side walls of the second shielding 41 each define a hole 418 therein for being received in the protrusions 402 of the first shielding 40. Therefore, the two shieldings 40, 41 can effectively enclose the insulative housing 1 as shown in FIG. 2.

Strain relief means 413 comprises a first strap 414 forming a tapered end 416 and a second strap 415 defining a cutout 417 for receiving the tapered end 416 of the first strap 414. Therefore, the two straps 414, 415 can enclose and fix the cable (not shown) to absorb a force applied on the engagement between the cable lines and the reception portion of the contacts when the cable is pulled.

Figure 5:
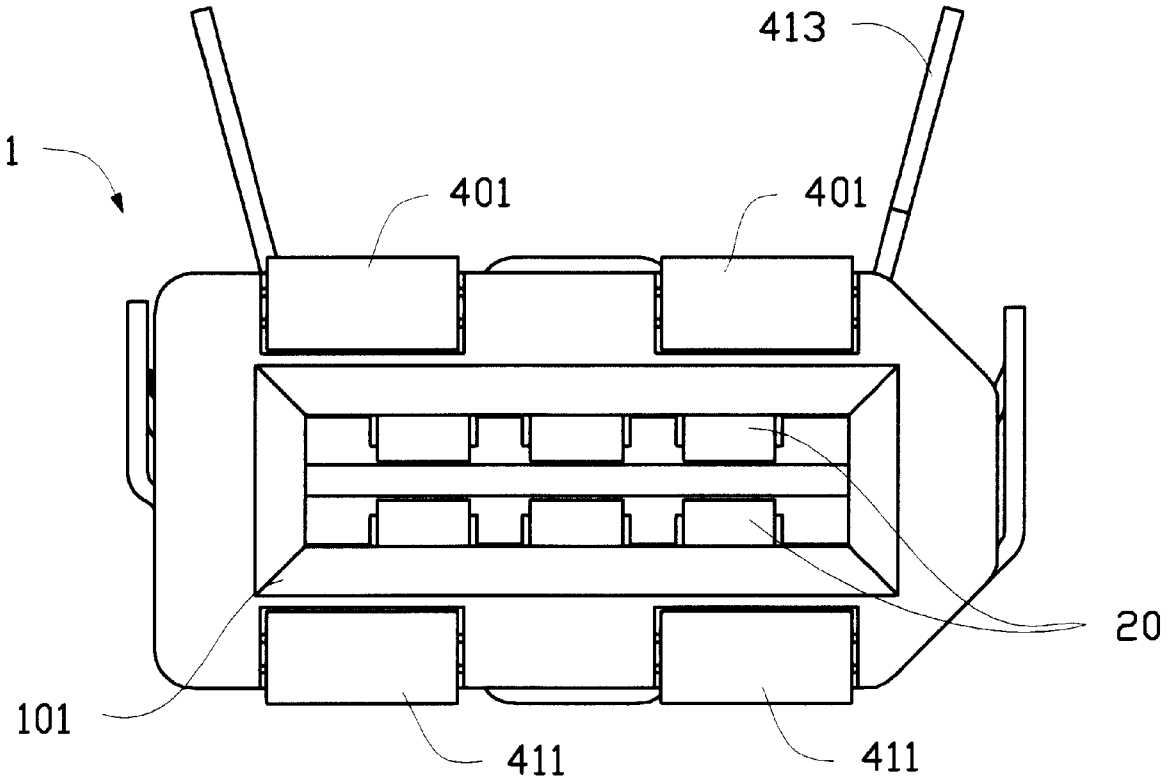
FIG. 5 is an elevational a view of the electrical connector taken from a front end which is to be engaged with a complementary connector.

Referring to FIG. 5, the two pairs of hooks 401, 411 of the electrical connector are attached to the reception surface 10 thereof for preventing the reception surface 10 of the insulative housing 1 from becoming worn due to repeated insertions/detachments of a complementary connector (not shown), i.e., any unwanted impact on the reception surface 10 of the insulative housing 1 is promptly absorbed by the hooks 401, 411 of the shielding means 4.

Figure 6:
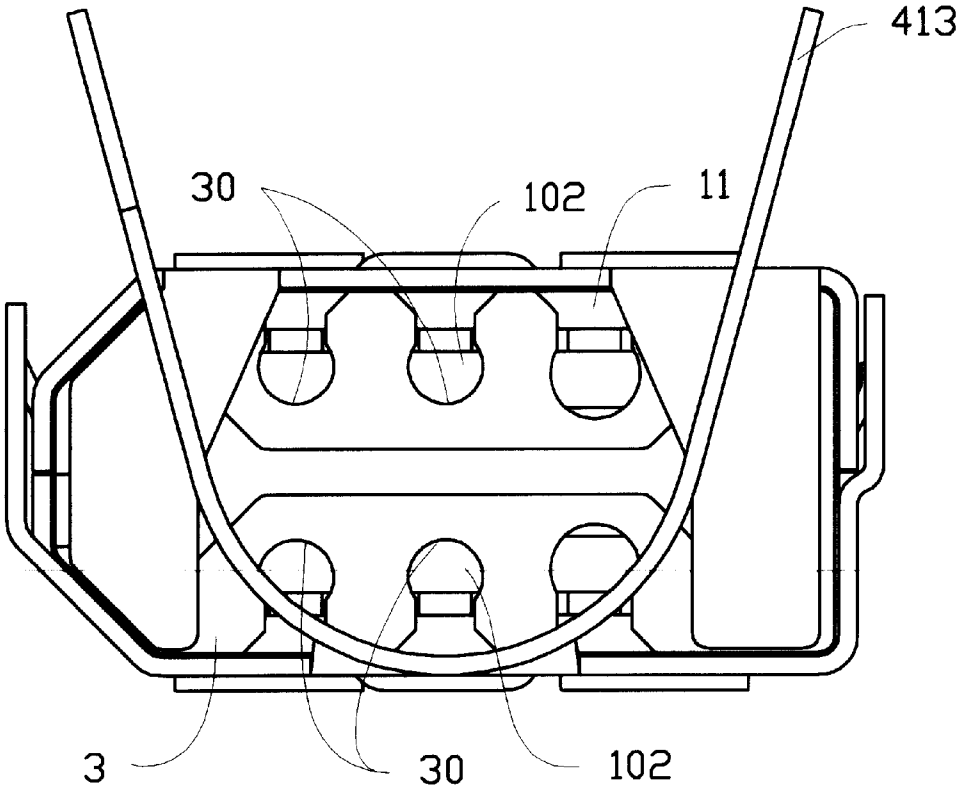
FIG. 6 is an elevational view of the electrical connector taken from a rear end which is to be connected to a cable.

Referring to FIG. 6, the positioning means 3 is positioned in front of the engaging surface 11 of the insulative housing 1, therefore any sputtered plastic particles may be blocked thereby, thus, preventing the plastic particles from entering the receptacles 102 through the engaging surface 11 during formation of a plastic shell (not shown) which encloses the shielding means 4. It should be noted that the cable is connected to the insulative housing 1 before the formation of the plastic shell.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An electrical connector comprising:

an insulative housing having a reception surface which defines a slot therein for receiving a complementary connector, an engaging surface opposite the reception surface for connecting with an external cable which comprises a plurality of cable lines, and a plurality of receptacles formed in the insulative housing and communicating between the reception surface and the engaging surface of the insulative housing;

a plurality of contacts respectively received in the receptacles of the insulative housing, each contact having a reception portion for electrically engaging with a corresponding cable line of the cable; and shield means comprising a first shielding and a second shielding secured together for enclosing the insulative housing and at least one end of the first and second shieldings being secured to a peripheral edge of the reception surface of the insulative housing, wherein the first shielding and the second shielding are substantially U-shaped and the second shielding comprises at least one first tab extending inwardly from one of two side walls thereof for abutting against positioning means;

the positioning means adapted to be received between the engaging surface of the insulative housing and the shielding means to abut against the engaging surface of the insulative housing, passageways being defined in the positioning means in communication with the receptacles and retain the cable lines therein;

wherein the positioning means prevents sputtered plastic particles from entering an interior of the insulative housing via the engaging surface during formation of a plastic shell which encloses the shielding means.

2. The electrical connector as claimed in claim 1, wherein the reception surface defines at least one recess in a peripheral edge thereof for receiving the at least one end of the shielding means.

3. The electrical connector as claimed in claim 2, wherein the at least one end of the shielding means is a hook structure.

4. The electrical connector as claimed in claim 1, wherein the reception portion of each contact is a U-shaped structure.

5. The electrical connector as claimed in claim 1, wherein the second shielding comprises at least one second tab extending from one of two side walls thereof and defining a hole therein, and the first shielding comprises at least one protrusion projecting from one of two side walls thereof adapted to be received within the hole of the at least one second tab of the second shielding when the first and second shieldings are engaged.

6. The electrical connector as claimed in claim 1, wherein the first shielding comprises strain relief means which includes a first strap cooperating with a second strap to enclose and fix the external cable to absorb a force applied on the engagement between the cable lines and the reception portion of the contacts when the cable is pulled.

7. The electrical connector as claimed in claim 6, wherein the first strap of the first shielding forms a tapered end and the second strap of the first shielding defines a cutout adapted to receive the tapered and of the first strap.

8. The electrical connector as claimed in claim 1, wherein the second shielding comprises strain relief means which includes a first strap cooperating with a second strap to enclose and fix the external cable to absorb a force applied on the engagement between the cable lines and the reception portion of the contacts when the cable is pulled.

9. The electrical connector as claimed in claim 8, wherein the first strap of the second shielding forms a tapered end and the second strap of the second shielding defines a cutout adapted to receive the tapered end of the first strap.

10. The electrical connector as claimed in claim 1, wherein the positioning means is fishskeleton-shaped and defines spaced passageways therein communicating with the receptacles of the insulative housing.

11. The electrical connector as claimed in claim 10, wherein each passageway of the positioning means has an entrance portion and a reception portion, and the entrance portion is narrower than the reception portion which has substantially the same dimension as each cable line for retaining each cable line within the reception portion of the corresponding passageway.

12. An electrical connector comprising:

an insulative housing having a reception surface defining a slot therein for receiving a complementary connector, an engaging surface opposite the reception surface for connecting with an external cable which comprises a plurality of cable lines, and a plurality of receptacles formed in the insulative housing and communicating between the reception surface and the engaging surface of the insulative housing;

a plurality of contacts respectively received within the receptacles of the insulative housing, each contact having a contact portion exposed to the slot for electrically connecting to a corresponding contact of the complementary connector; and shielding means generally surrounding most portions of the insulative housing and further including hook portions attached to the reception surface for preventing the reception surface from being worn out due to repeated insertion/detachment of the complementary connector; wherein a positioning means is positioned on a rear side of the engaging surface of the insulative housing, said positioning means including a plurality of passageways communicating with the corresponding receptacles in the housing and retaining the cable lines therein, and said shielding means includes at least one tab formed on a rear portion thereof for abutment against a rear side of the positioning means so as to retain the positioning means in position with regard to the insulative housing.

13. An electrical connector comprising:

an insulative housing having a reception surface defining a slot therein for receiving a complementary connector, an engaging surface opposite the reception surface for connecting with an external cable which comprises a plurality of cable lines, and a plurality of receptacles formed in the insulative housing and communicating between the reception surface and the engaging surface of the insulative housing;

a plurality of contacts respectively received within the corresponding receptacles of the insulative housing, each contact having a reception portion for electrically engaging with one corresponding cable line of the cable; and positioning means provided on a rear side of the engaging surface of the insulative housing, passageways being defined in the positioning means in communication with the corresponding receptacles, respectively, and retaining the corresponding cable lines therein, whereby the positioning means prevents sputtered plastic particles from entering an interior of the insulative housing via the engaging surface during formation of a plastic shell of the connector; wherein said connector further includes shielding means generally surrounding most portions of the insulative housing, and said shielding means includes at least one tag on a rear portion thereof for abutment against said positioning means and retaining said positioning means in position in the connector.

* * * * *